United States Patent [19]

Strubel

[11] Patent Number: 4,828,131

[45] Date of Patent: May 9, 1989

[54] TRANSPORT CONTAINER FOR VERY PURE CHEMICALS

[75] Inventor: Norbert Strubel, Lampertheim, Fed. Rep. of Germany

[73] Assignee: Merck Patent Gesellschaft Mit Beschränkter Haftung, Darmstadt, Fed. Rep. of Germany

[21] Appl. No.: 113,962

[22] Filed: Oct. 29, 1987

[30] Foreign Application Priority Data

Oct. 30, 1986 [DE] Fed. Rep. of Germany ..... 3636888

[51] Int. Cl.[4] ..... B65D 6/00

[52] U.S. Cl. ..... 220/5 R; 220/5 A; 222/3; 222/464

[58] Field of Search ..... 206/0.6; 220/5 R, 5 A; 222/3, 399, 464, 382

[56] References Cited

U.S. PATENT DOCUMENTS

| | | | |
|---|---|---|---|
| 1,767,680 | 6/1930 | Hutt | 222/399 |
| 1,847,178 | 3/1932 | Garnett | 222/399 |
| 1,854,352 | 4/1932 | Thomas | 222/3 |
| 2,595,317 | 5/1952 | White, Jr. | 222/399 |
| 4,103,806 | 8/1978 | White | 222/3 |
| 4,478,345 | 10/1984 | Edinger | 220/5 A |
| 4,666,062 | 5/1987 | Pershall | 222/399 |
| 4,690,299 | 9/1987 | Cannon | 220/5 R |

FOREIGN PATENT DOCUMENTS

| | | | |
|---|---|---|---|
| 1421821 | 11/1965 | France | 220/5 R |

*Primary Examiner*—David T. Fidei
*Attorney, Agent, or Firm*—Millen & White

[57] ABSTRACT

The present invention provides transport container of corrosion-resistant steel for very pure liquid chemicals, said container having at least one screw connection in the upper container wall with an immersion tube having a connection piece extending to the bottom of the container. A protective collar, provided with openings, surrounding the screw closure at a distance therefrom, wherein the connection piece of the immersion tube is led off off-center, within the protective collar from the upper container wall. The lower end of the immersion tube is welded to the container bottom.

5 Claims, 1 Drawing Sheet

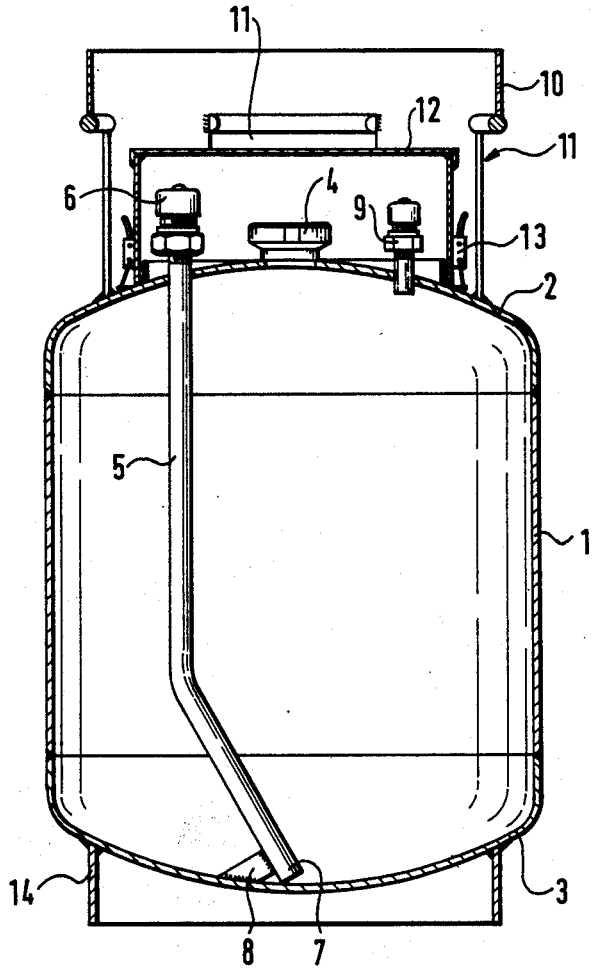
11
10
12
11
6
4
9
13
2
5
1
14
3
8
7

TRANSPORT CONTAINER FOR VERY PURE CHEMICALS

BACKGROUND OF THE INVENTION

The present invention is directed to a transport container made of corrosion-resistant steel for retaining very pure liquid chemicals. The container has top wall with at least one screw closure and an immersion tube having a connection piece extending to the bottom of the container. A protective collar, provided with openings, surrounds the screw closure in spaced relation thereto.

In the production of electronic components, such as integrated circuits, liquid chemicals are needed, the purity of which must be as high as possible. During transport, storage and handling, contamination of these chemicals must be avoided. Since, in many cases, these chemicals are toxic or harmful in other ways, an unintended overflow caused, for example by damaging the transport container, must be precluded with great certainty.

The requirement of excluding all contaminations is admittedly fulfilled by glass containers. However, danger of breakage precludes their use as transport containers. In order to keep the mechanical stresses low, synthetic resin containers used for these purposes have hitherto been exclusively made as pressureless containers. However, this makes it necessary also to carry out the removal of the chemicals without the use of pressure, namely by means of suction pumps. In that suction pumps have moving parts rubbing against one another, contamination by wear occurring in the pump cannot be completely excluded.

Transport containers made of steel of the initially mentioned type can admittedly be made as pressure containers for higher mechanical stressing; however, the immersion tube necessary for the removal gives rise to constructional difficulties. The immersion tube is usually a component of a removal fitting which is placed on the screw closure or closure flange of the container. Since the immersion tube extends freely into the container, it is subject to comparatively high mechanical bending stresses when the liquid contained in the container moves about during transport. Since the immersion tube must extend to immediately above the bottom of the container in order to make possible the greatest emptying, the danger exists that the immersion tube touches the bottom of the container, which can result in rubbing between the immersion tube and the bottom of the container. The resulting wear contaminates the liquid.

SUMMARY OF THE INVENTION

It is an object of the present invention to construct a transport container of the initially mentioned kind that, without impairment of transport safety and where all wear due to touching of metallic parts is completely avoided.

Thus, according to the present invention, there is provided a transport container of corrosion-resistant steel for very pure liquid chemicals, said container having at least one screw connection in the upper container wall, with an immersion tube having a connection piece extending to the bottom of the container. A protective collar, provided with openings, surrounds the screw closure in spaced relation thereto. The connection piece of the immersion tube is led off off-center, within the protective collar from the upper container wall and the lower end of the immersion tube is connected by welding to the container bottom.

The firm connection of the immersion tube to the bottom of the container ensures that the lower end of the immersion tube, independently of the tolerances maintained in the production of the bottom of the container, is always present immediately above the deepest part of the bottom of the container without, however, it being able to come into rubbing contact therewith and thus causing metallic wear.

Since the connection piece of the immersion tube is no longer led off through a removable closure lid, but is passed in outside of the central screw closure through the upper container wall and is welded therewith, the immersion tube can remain permanently attached to the container without access through the screw closure being impaired. The screw enclosure can therefore conviently serve as a clearing opening. Only by this permanent attachment of the immersion tube to the top container is the permanent connection to the bottom of the container possible. However, since the connection piece of the immersion tube still lies within the protective collar, the mechanical protection necessary for transport is ensured.

Thus, the present invention provides a transport container for very pure liquid chemicals which can be made and used both as a steel container and as a pressure container which makes possible the removal of the liquid chemicals without the use of suction pumps or other moving parts so as to avoid contamination due to wear caused by rubbing of metallic parts.

The lower end of the immersion tube is preferably connected with the bottom of the container via a welded-on bar. The use of this bar provides welding seams which are simple to produce and to control, not only on the bottom of the container but also on the immersion tube. Furthermore, in the production of the transport container, the bar makes possible limited movability of the immersion tube so that it can be aligned in the necessary way before it is welded with the upper container wall.

The immersion tube is preferably so arranged that it runs vertically downwardly from the connection piece and is angled in its lower region from the middle to the lowest point of the bottom of the container. The immersion tube thereby does not impair the access to the transport container through the central screw closure. Furthermore, the lower end of the immersion tube is present at the place providing for a complete emptying of the container, namely, at the deepest point in the middle of the bottom of the container.

Furthermore, the angled construction of the immersion tube has the result that any expansion differences between the container and the immersion tube which can arise during production or, for example, due to external temperature influences, do not lead to substantial stress peaks although the immersion tube is welded not only to the upper container wall but also the bottom of the container.

In further development of the concept of the present invention, on the side lying opposite to the connection piece of the immersion tube, there is provided a gas inlet piece which passes out of the upper container wall. Thus, not only the connection piece of the immersion tube, but also the gas inlet piece are present outside of the removable, central screw closure and can, therefore, be firmly welded to the container.

In addition to this separated arrangement of the connections on the upper container wall, mechanical damage during transport is prevented to the greatest possible extent by the surrounding protective collar. A further protection of these connections, especially against contamination during transport, can be achieved in that a protective cap, covering the connection piece of the immersion tube, the screw closure and the gas inlet piece, is removably fixed by means of snap closures on the upper container wall inside the protective collar. This protective cap protects against dust and other contaminations dropping from above. When the protective cap is removed, the pipes in the upwardly domed upper container wall are freely accessible and can, in particular, also be completely flushed by a laminar air screen descending from above onto the transport container in a clean room.

This purpose is also served by the further advantageous feature of the present invention wherein the openings of the protective collar extend down to the upper container wall. A uniform laminar air stream flowing down from above in a clean room can flow off, out and downwardly, substantially free of eddy currents, from the space within the protective collar through the openings.

The transport container is optimally constructed for cleaning procedures since dead spaces and disturbing edges are avoided.

The present invention will now be explained in more detail in the following with reference to an embodiment thereof which is illustrated in the accompanying drawing.

BRIEF DESCRIPTION OF THE DRAWING

The drawing is a side view, in section, of a transport container in accordance with the instant invention.

DETAILED DESCRIPTION

The drawing shows, in vertical section, a transport container for very pure liquid chemicals, such as are needed in the electronics industry, for example, for the production of integrated constructional parts and memories of very high memory density. The transport container, which is made from corrosion-resistant steel by welding, has a cylindrical wall section 1, the upper container wall 2 or top of which and the lower container wall or bottom 3 of which are each formed by a domed plate in conventional manner. In the upper container wall or top 2 is a first opening with a centrally arranged screw closure 4 which can be opened for cleaning and inspection purposes.

Filling and emptying of the container takes place through an immersion tube 5 which, on its upper end, has a connection piece 6 which passes through a second opening in the upper container wall 2, laterally in spaced relation to the screw closure 4, and is welded to the upper container wall 2. From there, the immersion tube 5 extends vertically downwardly and, in its lower region, is angled at about 30° towards the middle of the container. The lower end 7 of the immersion tube 5 is positioned directly above the deepest place in the middle of the container bottom 3. It is connected via a lateral bar 8 to the container bottom 3 by means of welding.

In order to remove liquid present in the transport container through the immersion tube 5 and a pipe attached to the connection piece 6, inert pressurized gas, preferably nitrogen, must be introduced into the upper region of the container. For this purpose, there a gas inlet piece 9 is provided in the form of a gas inlet pipe which passes through a third opening in the upper container wall 2, on the side lying opposite to the connection piece 6. The inlet piece 9 is also welded to the upper container wall 2.

A protective collar 10 placed on the outer edge of the upper container wall 2 and also welded to this surrounds the connection piece 6, the screw closure 4 and the gas inlet piece 9 and provides a mechanical protection for these parts. Openings 11 in the protective collar 10 serve as grip openings. They extend down to the upper container wall 2 so that a laminar air screen flowing from above onto the transport container, such as is frequently used in clean rooms, flows over all the connection parts provided on the upper container wall 2, free of eddy currents, and can flow off through the openings 11.

A substantially cylindrical protective cover or cap 12 provided with a flat covering wall is positioned within the protective collar 10. It covers the screw closure 4, the connection piece 6 and the gas inlet piece 9 and lies with its lower edge on the upper side of the upper container wall 2. There are there present several snap closures 13, externally accessible through the openings 11, with which the protective cap 12 is removably fixed onto the upper container wall 2. After removal of the protective cap 12, no parts remain behind on the container which could impair the unhindered flowing off of a laminar air screen.

A low cylindrical ring 14 welded on the container bottom 3 forms a standing ring for the transport container. It is to be understood that the choice of material for the transport container must be such that the corrosion-resistant steel used is not attacked by the chemicals to be transported and in particular, does not contaminate the chemicals. The connection piece 6 and the gas inlet piece 9 can, as indicated in the drawing, be provided with snap closure connections, both connections preferably being made differently so that mistakes are impossible. A coding of the connections, depending upon the nature of the chemicals contained in the transport container, is also possible.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A transport container for materials, the container being made of a single shell of corrosion-resistant steel so as not to contaminate materials contained therein, the container having top, bottom and side walls; a first opening through the top wall for cleaning and inspecting the container, the first opening being closed by a screw cap; a second opening through the top wall, the second opening being spaced laterally of the first opening; a tube extending through the second opening and down into the container for filling and emptying the container, the tube having a first open end secured to the bottom wall of the container by welding and a second end being closed by a screw cap; a third opening through the top wall, the third opening being spaced laterally of the first and second openings and having a gas inlet pipe therethrough; a protective cover fitting over the screw caps and means for releasably securing the protective cover to the container; and a protective collar extending from the top wall past the protective cover, the protective collar having openings therethrough permitting air to flow freely over and around the protective cover.

2. The transport container of claim 1, wherein the bottom wall is concave with respect to the inside of the container so as to have a lowest point and wherein the tube has a bend therein so as to position the open end adjacent the lowest point of the bottom wall.

3. The transport container of claim 1, further including an annular flange positioned outside of the container on the bottom wall for supporting the container.

4. The transport container of claim 1, wherein the openings in the protective collar extend downwardly to the upper container will and wherein the means for releasably securing the protective cover to the container are latches positioned inboard of and adjacent to the openings.

5. The transport container for pure bound materials, the container being made of a single shell of corrosion-resistant steel so as not to contaminate materials contained therein, the container having top, bottom and side walls; the top and bottom walls being circular and concave with respect to the interior of the container and having aligned centers and the side wall being cylindrical about an axis of the container which passes through the center of the top and bottom walls; a circular flange positioned exteriorly on the bottom wall for supporting the container; a first opening through the top wall for cleaning and inspecting the container, the first opening being closed by a screw cap; a second opening through the top wall, the second opening being spaced laterally of the first opening; a tube extending through the second opening and down into the container for filing and emptying the container, the tube having a bend therein for positioning a first open end secured to the bottom wall of the container adjacent to the axis of the container by welding and a seocnd end being closed by a screw cap; a third opening through the top wall, the third opening being spaced laterally of the first and second openings and having a gas inlet pipe therethrough for pressurizing the container; a protective cover fitting over the screw caps and latch means for releasably securing the protective cover to the container; a protective collar extending from the top wall past the protective cover, the protective collar having openings therethrough permitting air to flow freely over and around the protective cover, the openings being adjacent to the latch means for securing the protective cover.

* * * * *